United States Patent [19]

Boone

[11] 4,004,687

[45] Jan. 25, 1977

[54] DEVICE FOR POSITIONING A CONTAINER OF SUPPLEMENTAL MATERIAL ADJACENT TO A TOILET-TISSUE HOLDER

[76] Inventor: Philip Boone, 15 Fenwick Road, Winchester, Mass. 01890

[22] Filed: Apr. 14, 1975

[21] Appl. No.: 568,034

Related U.S. Application Data

[63] Continuation-in-part of Ser. No. 526,963, Nov. 25, 1974, Pat. No. 3,943,859.

[52] U.S. Cl. ..... 206/233; 118/506; 206/210; 206/536; 206/812; 220/18; 221/45; 242/55.53; 312/39; 248/214; 248/302; 248/312; 248/226.5

[51] Int. Cl.[2] ..... B65Q 83/04; B65Q 85/00

[58] Field of Search ..... 206/205, 210, 216, 233, 206/225, 535, 536, 812; 248/226 R, 226 D, 214, 302, 310, 311 R, 312, 315; 220/18; 242/55.53, 55.55; 312/39; 118/506; 221/135, 45, 63

[56] References Cited

UNITED STATES PATENTS

| | | | |
|---|---|---|---|
| 1,778,568 | 10/1930 | Schulte | 248/226 R |
| 2,517,244 | 8/1950 | Rundell | 248/302 |
| 2,699,780 | 1/1955 | Rudnick et al. | 206/210 |
| 2,705,385 | 4/1955 | Markward | 248/214 |
| 2,725,208 | 11/1955 | Bova | 248/214 |
| 2,749,056 | 6/1956 | Jenkins | 312/39 |
| 2,875,974 | 3/1959 | Albert | 248/310 |
| 3,068,492 | 12/1962 | Price | 248/311 R |
| 3,086,724 | 4/1963 | Powell | 242/55.53 |
| 3,192,008 | 6/1965 | Dwyer | 242/55.55 |
| 3,386,619 | 6/1968 | Douglas | 221/135 |
| 3,653,624 | 4/1972 | Abel | 248/312 |
| 3,698,675 | 10/1972 | Lerew et al. | 248/311 R |
| 3,734,439 | 5/1973 | Wintz | 248/226 R |
| 3,749,296 | 7/1973 | Harrison | 206/205 |
| 3,841,466 | 10/1974 | Hoffman et al. | 221/45 |

*Primary Examiner*—William Price
*Assistant Examiner*—Bruce H. Bernstein

[57] ABSTRACT

An improved compact device easily attached by sliding it onto one post of a standard roll-type toilet-tissue holder for positioning a container of a material particularly usable for health care or personal hygiene purposes at that location, e.g., a material such as prewetted or self-wetting sheets, an encapsulated liquid, a pressurized liquid, etc., and holding the container in a given manner pending or during its usage.

10 Claims, 13 Drawing Figures

DEVICE FOR POSITIONING A CONTAINER OF SUPPLEMENTAL MATERIAL ADJACENT TO A TOILET-TISSUE HOLDER

The present application is a continuation-in-part of my copending U.S. patent application Ser. No. 526,963 filed Nov. 25, 1974 for "Shelf Attachment" now U.S. Pat. No. 3,943,859.

BRIEF SUMMARY OF THE INVENTION

The subject invention is principally concerned with an attachment device enabling the positioning of health-care materials for application to the human body by mounting a container thereof on a single post of a standard toilet-tissue holder, formed, for example, of either a metallic or ceramic material. No modification of the holder is required. The container thus becomes, in effect, an attractive integral part of the toilet-tissue holder. Among advantages of the device are the provision of means for effecting a release of the contained materials easily and positively and means enabling the installation or removal of a container without having to disengage or reengage any component of the toilet-tissue holder. Advances over the art are believed to comprise: (a) rigid mounting means attaching the container to but one post of the toilet-tissue holder; (b) rapid slide-on attachment means; (c) elimination of encumbering structure so that no interference with the rotation of, or removal of tissue from, the roll can occur; (d) a stable container mounting providing a firm purchase for removal of its contents; (e) mounting of the container independently of the roll of tissue; (f) a simple inexpensive structure having a permanent custom-installation appearance.

In accordance with the foregoing considerations, objects of the invention are to provide an improved device for making available a body cleansing or treating substance more conveniently adjacent to a toilet-tissue holder; to provide a shelf-like attachment for the toilet-tissue holder having improved supporting means; to provide a rigid supporting means for attaching a container to but one post of the toilet-tissue holder; to provide improved supporting means for a magazine containing a plurality of capsules bearing a hermetically sealed liquid; to provide a rapid slide-on type of fastening means for gripping the post of the toilet-tissue holder; to provide a device of the type characterized in which mounting or dismounting of the container is completely independent of installation or removal of a roll of toilet-tissue; and to provide a more attractive, simple and less expensive device of the character described in relation to the art. Other objects of the invention will in part be obvious and will in part appear hereinafter.

BRIEF DESCRIPTION OF THE DRAWING

The novel features which are believed to be characteristic of the invention are set forth with particularly in the appended claims. The invention, however, both as to its organization and its method of operation will best be understood from the following description when read in connection with the accompanying drawing wherein like numbers have been employed in the different figures to denote the same parts and wherein:

DETAILED DESCRIPTION

Figures 1, 2, 3, 4, 5, 6, 7, 8, 9, 10, 11, 12, 13:
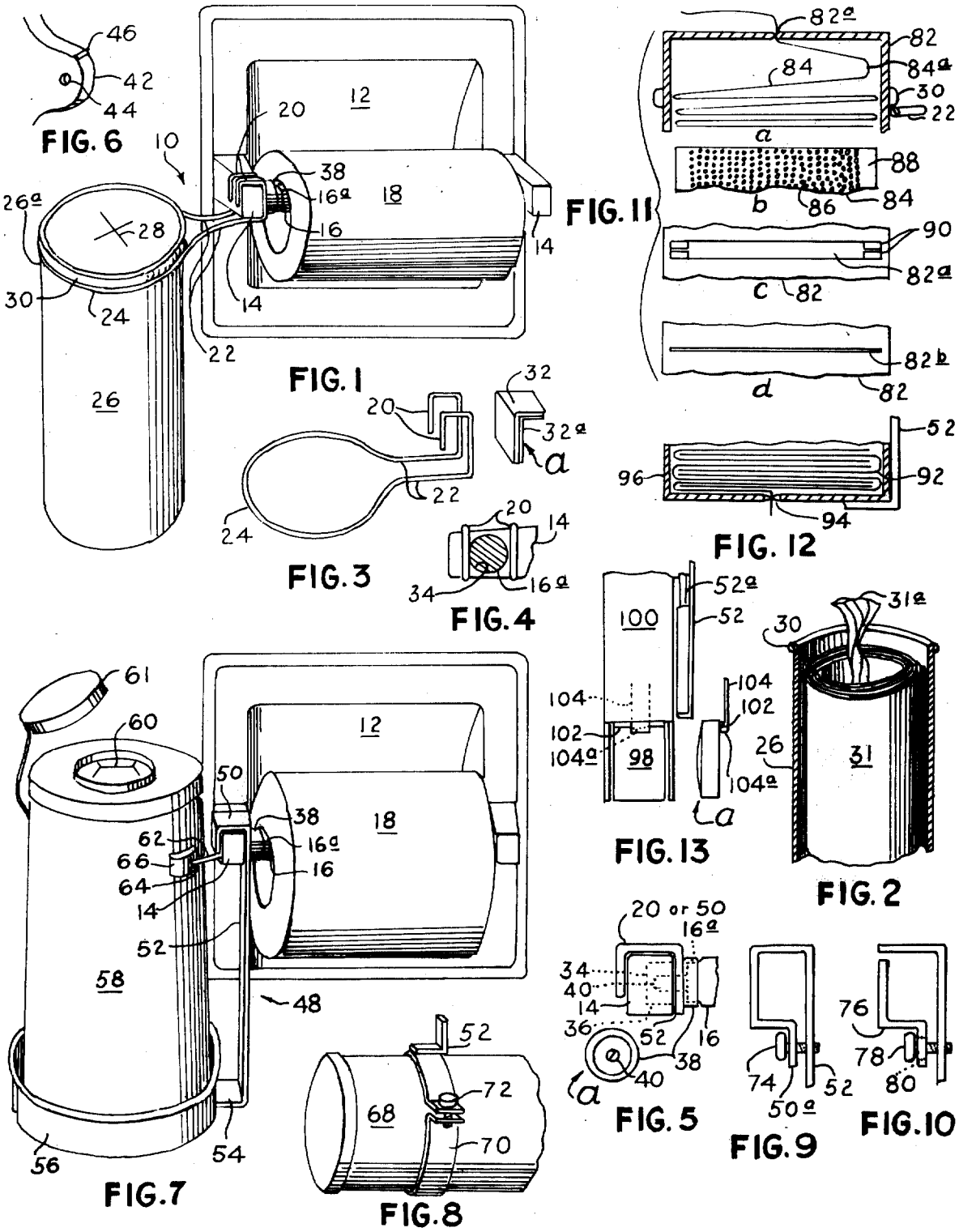
FIG. 1 is a diagrammatic perspective view of one form of the positioning device of the invention attached to one post of a standard toilet-tissue holder.
FIG. 2 is a fragmentary perspective view, partially in crosssection, illustrating removal of a prewetted sheet material from the container element of FIG. 1.
FIG. 3 is a diagrammatic perspective of a slide-on adapter element of FIG. 1.
FIG. 4 is a fragmentary elevation view illustrating an alternate method of mounting the spindle of the toilet-tissue holder in relation to the mounting means of FIGS. 1 and 3.
FIG. 5 is a fragmentary side view of the fastening means relative to one post of the toilet-tissue holder and of cupped means for mounting one end of the holder spindle.
FIG.6 is a fragmentary perspective view of the toilet-tissue holder post of FIG. 1.
FIG. 7 is a diagrammatic perspective view of a modification of the positioning device of the invention attached to a single post of a standard toilet-tissue dispenser.
FIG. 8 is a fragmentary side view of means integral with the supporting arm member of FIG. 7 for positioning the container horizontally.
FIGS. 9 and 10 are fragmentary side views of alternate means for securing the positioning device to one post of the the toilet-tissue holder.
FIG. 11, *a*, *b*, *c*, and *d* are fragmentary views of means for supplying a self-wetting sheet material in conjunction with a supporting arm member of the type of FIGS. 1 or 7.
FIG. 12 is a fragmentary view, partly in cross-section, of a container holding a plurality of interleaved wetted sheets, supported by an arm member of FIG. 7.
FIG. 13 is a fragmentary elevation view of a container such as a magazine releasably holding body-treating means in the form of liquid-carrying capsules, the magazine being supported by an arm member such as that of FIG. 7.

In FIG. 1 there is shown one form of the positioning device 10 of the invention mounted on a conventional toilet-tissue holder 12 which may appropriately be formed of a metal and which includes a pair of forwardly projecting posts 14 and a telescoping retractable spindle 16 bearing a roll of toilet-tissue 18. The positioning device 10 includes angular fastening elements 20 substantially encircling and gripping one of the posts 14, the arm components 22 integral at one end with the fastening elements 20 and extending a horizontal direction from the post, and the ring-like supporting component 24 integral with an opposite end of the arm members 22. A container 26, formed, for example, of a suitable plastic composition such as polystyrene, polypropylene, a polycarbonate, ABS, etc., and having a self-closing aperture 28, is mounted within the supporting component 24. The upper side portions **26*a* of the container may be slightly flared and, thereby, of increased circumference so that the container is wedged into the ring 24 when fully inserted and is held firmly against displacement when, for example, a sheet material may be withdrawn therefrom through the aperture 28. A raised bead 30 serves as a limit stop for positively holding the container in position. The container 26, suitably, may hold a supply of prewetted inter-attached sheets 31 (FIG. 2) of a type which are adapted to be drawn by a leader 31*a* and separated for individual use at the aperture 28, following use of the conventional toilet-tissue sheets 18**.

Semi-perforations (not shown) of the sheet material 31 facilitate their individual separation.

The unitary fastening elements 20, arm components 22 and supporting component 24, taken together, may be considered an adapter element, more clearly shown in FIG. 3. An optional angular plate 32, having resilient marginal flange portions 32a, may be included to provide an enhanced appearance.

FIGS. 4 and 5 illustrate two types of means for releasably attaching the spindle 16 relative to the post 14. In the fragmentary side view of FIG. 4, an extremity 16a of the spindle is to be assumed as introduced directly into the conventional bore 34 formed in the post, that is laterally between the fastening elements 20 which are spaced apart for the purpose. It will be noted that contact with the spindle prevents any sideways movement of the elements 20 to the left thus preventing any possibility of their slipping off of the post. In FIG. 5, an insert element or plug 36, formed of any suitable material such as a plastic above named, is tightly inserted in the bore 34. An external cupped element 38 is attached to the plug by any suitable means such as a pin or screw 40 passing between the elements 20, the latter being closer together, laterally, than shown in FIG. 4 so that the screw acts to prevent sideways slippage of elements 20. In the construction of FIG. 7, described below, the screw 40 passes through a perforation formed in an arm member thereof. The spindle extremity 16a rests in the cupped element 38, as urged by a biasing spring of the conventional spindle whereby element 38 is pressed against elements 20 and provides an additional force for holding them firmly engaged with post 14. The interior of cupped element 38 is shown at FIG. 5a. Either type of construction, above described, can be used with the positioning device of FIG. 1; only that of FIG. 5 with the device of FIG. 7.

A modification of the post 14 is shown in FIG. 6. The post 42, having bore 44, is typical of a ceramic toilet-tissue holder. It will be noted that upper and lower surfaces are quite inclined, rear to front, To insure firm attachment thereto of the gripping components 20 (FIGS. 1 and 3) or of modified fastening means described below, one or more transverse raised strips 46, formed, for example, of an adhesive tape or a plastic cement, or grooves filed in the upper surface of the post may be employed to provide surfaces for engagement of means 20.

In FIG. 7 there is illustrated a modified positioning device 48 of the invention, mounted on a conventional toilet-tissue 12 identical to that of FIG. 1, including the posts 14 and spindle 16 bearing the roll of tissue 18. The positioning device 48 comprises an angular slide-on fastening element 50, formed to grip the post 14, a rigid arm member 52 integral at its upper end with the fastening element 50 and extending therefrom downwardly, and the supporting element 54 integral with the lower end of the arm member. The fastening element 50, arm member 52 and supporting element 54, taken together, may be considered an adapter element comparable to that described relative to FIG. 1.

Further referring to FIG. 7, a flange or rim member 56, of a given slight resiliency, is unitary with the supporting element 54. The latter, with or without the rim, may be considered as a platform or shelf adapted to support a variety of objects at a location indicated. As shown, a container 58 is mounted on the support 54 and bounded by the flange 56. The container and flange may be of any cooperative configurations whereby the container is lightly wedged within the flange and may be withdrawn therefrom manually. Accordingly, a sheet material may be withdrawn through the container aperture 60 without dislodging the container. The container may be formed of a suitable plastic material such as one mentioned hereinbefore. A cap 61 provides a seal over the aperture 60 and a similar item may be provided the container of FIG. 1. It is to be noted that container 26 of FIG. 1 and container 58 of FIG. 7 can instantly be lifted from the repective adapters and used independently, e.g., as portable means for supplying wetted sheet materials. Assuming use of the container mounted as shown, an additional firmness thereof may be provided by the pin 62 integral with fastening element 50 which is adapted to enter an aperture 64 formed in a small protuberance 66 on the container wall. A similar or modified means may be employed to determine the rotational position of the container where this is of advantage. Attachment of the spindle 16, carrying the roll of tissue 18, is as shown in FIG. 5, the pin 40 passing through a central perforation in the arm member 52. In this instance, the pin or screw 40 also serves to prevent sideways slippage of the fastening element 50. A modification would have the cupped element 38 an integral part of the fastening element 50 and the plug 36 a very shallow slightly rounded component. This would permit the entire assembly still to be slid endwise onto the post, assuming a slight resiliency of element 50, and would permit elimination of the pin 40.

FIG. 8 illustrates means for positioning a container 68 horizontally through attachment of holding means therefor 70 to the arm member 52 of FIG. 7. The holding means 70 is in the form of a split circular band. A tensioning screw 72 enables tightening of the band around the container.

FIGS. 9 and 10 exemplify means adapted to incorporation with the structure of FIG. 7. In FIG. 9 an angular extension 50a of the fastening element 50 is provided. A tensioning screw 74 passes through this extension and is threaded in the arm member 52. When tightened, the post 14 can be gripped more tightly. In FIG. 10 a separate angular fastening element 76 is provided. A tensioning screw 78 passes through a vertical slot formed in the member 76 at 80 and is threaded in the arm member 52. This structure provides a fastening element adapted to accommodate to posts of various and lateral dimensions.

FIG. 11a illustrates a modified container 82, having an exit aperture at 82a, of a type for supplying a self-wetting sheet material 84. Means are shown for providing the sheet in either a dry state for wetting on contact with an external surface, e.g., the human body, or in a wetted condition upon withdrawal from the container. The container, preferably of a rectangular shape, may be supported by an adapter element generally as described relative to FIG. 1 or FIG. 7, the former being indicated. The sheet material 84 is folded in any suitable manner, e.g., in an accordion form, with semi-perforations 84a at spaced intervals for providing separated sheets.

As shown in FIG. 11b, the sheet material 84 has a plurality of minute, liquid-bearing, frangible capsules 86 distributed throughout a given surface area thereof, margins 88 being free of the capsules. FIG. 11c shows one form of the aperture 82a FIG. 11a) whereat the sheet 84 may be withdrawn without applying pressure to the area bearing the capsules 86. The sheet is supported only at the margins 88 by the platforms 90. Alternatively, if it is desired that the sheet material be withdrawn in an already-wetted condition, the aperture may be in the form of 82*b*, shown in FIG. 11*d*, namely, of a close spacing such as to compress and fracture the capsules when the sheet 84 is drawn therebetween.

In FIG. 12 a plurality of wetted interleaved sheets 92 are shown. They may be withdrawn individually between resilient aperture means 94 of a container 96. Means 94 provide a seal at the aperture for retaining moisture within the container. As illustrated, the container 96 is supported by the arm member 52 (FIG. 7) but could be mounted on a slight modification of the adapter element of FIG. 1, that is, to accommodate to its rectangular shape.

FIG. 13 illustrates the mounting of a plurality of hermetically sealed liquid-bearing capsules 98 for individual withdrawal from a magazine 100. The magazine is mounted on the arm member 52 (FIG. 7) by a tongue and groove supplement indicated at 52*a*. Again, it could be supported by a modification of the adapter element of FIG. 1. As additionally shown in the side elevation at FIG. 13*a*, the capsule includes a transverse flange 102. A nozzle (not shown) extends through the center of this flange to its outer surface, whereby, when an inner valve or membrane is opened through manual compression of the capsule, the liquid is forcefully emitted. Each leading capsule is held lightly against release by the resilient arm 104 having a retaining tip 104*a* which releasably engages the flange 102 but permits withdrawal of the capsule.

In the examples of FIGS. 1, 3 and 7, the fastening or gripping elements 20 or 50 are shown as bent in a counterclockwise direction for engaging the post 14. While this is a preferred construction, it will be understood that they could be bent in a clockwise direction which would alter the position of the arm members 22 or 52, respectively. As will be apparent, the arm members and container support means can be altered as to length amd form and be otherwise directed, for example to position the container at an obscure location below the toilet-tissue holder.

Liquids of the type contemplated herein may, for example be water, water and alcohol, water, alcohol and an emollient such as lanolin or any other desired wetting agent, Any medicament suitable to the desired purpose may be utilized.

It will be understood that the subject invention may be practiced or embodied in other ways without departing from the character or spirit thereof. The preferred embodiment described herein is to be regarded, therefore, as illustrative and not restrictive, the scope thereof being indicated by the appended claims, and all variations which come within the meaning of the claims are intended to be embraced therein.

I claim:

1. An improved device for positioning a container of health care material adajcent to a standard toilet-tissue roll holder, said holder including a principal body component and a pair of forwardly projecting posts, each of said posts having upper, lower and side surfaces and a bore formed to receive a spindle of a toilet-tissue roll, said improved device comprising:

a container with health care material therein;

an aperture in said container enabling said material to be released;

a rigid unitary arm member positioning said container with respect to said holder;

angular slide-on fastening means integral with one extremity of said arm member which substantially encircles and firmly grips one of said posts and which determines the position in which said arm member extends;

means to fixedly position said fastening means along said post;

support means integral with the other extremity of said arm member to bear said container; and means on said container to releasably engage said support means and prevent inadvertent displacement, said container being removable without adjusting any of said holder, fastening means, arm member, or support means.

2. An improved device as defined in claim 1 wherein said angular fastening means includes a movable clamping element and tensioning means to allow gripping of posts of various dimensions.

3. A device as defined in claim 1 wherein the bore of said post has an insert element firmly seated therein having an associated external cupped component for receiving an extremity of said toilet-tissue holder spindle.

4. A device as defined in claim 3 wherein said insert element and cupped component are separable and are held together in substantially coaxial relation by a central attaching means.

5. A device as defined in claim 4 wherein said central attaching means passes through an opening formed between transverse limits of a vertical component of said fastening means.

6. A device as defined in claim 1 wherein said container is in the form of a magazine releasably holding a plurality of liquid-carrying frangible capsules.

7. A device as defined in claim 1 wherein said container is of a generally rectangular form and adapted to carry sheet material serving a human-body wetting function.

8. A device as defined in claim 1 wherein said arm member extends in a generally horizontal direction.

9. A device as defined in claim 1 wherein said arm member extends in a generally vertical direction.

10. A device as defined in claim 1 wherein said means to fixedly position said fastening means along said post includes means cooperating with structural retaining means identified with said roll holder.

* * * * *